US005176551A

United States Patent [19]

Blanchard et al.

[11] Patent Number: 5,176,551

[45] Date of Patent: Jan. 5, 1993

[54] ARRANGEMENT FOR SUPPLYING COMBUSTION AIR TO AN OUTBOARD MOTOR

[75] Inventors: Clarence E. Blanchard, Kenosha, Wis.; Jeffrey P. Higby, Wildwood; Charles D. Strang, Antioch, both of Ill.

[73] Assignee: Outboard Marine Corporation, Waukegan, Ill.

[21] Appl. No.: 847,437

[22] Filed: Mar. 6, 1992

Related U.S. Application Data

[63] Continuation of Ser. No. 644,001, Jan. 18, 1991, abandoned.

[51] Int. Cl.[5] ..... B63H 5/12

[52] U.S. Cl. ..... 440/88; 440/77

[58] Field of Search ..... 440/77, 88, 53, 900, 440/76; 114/211; 285/189, 192

[56] References Cited

U.S. PATENT DOCUMENTS

| | | | |
|---|---|---|---|
| 1,511,867 | 10/1924 | Asbury . | |
| 1,846,283 | 2/1932 | Summers . | |
| 2,235,140 | 3/1941 | Clarke | 123/195 |
| 3,172,399 | 3/1965 | Lantz et al. | 285/189 X |
| 3,487,804 | 1/1970 | Kiekhaefer | 440/76 |
| 3,702,485 | 11/1972 | Thompson | 440/900 |
| 4,080,184 | 3/1978 | Petersen | 55/315 |
| 4,371,348 | 2/1983 | Blanchard | 440/52 |
| 4,375,356 | 3/1983 | Stevens | 440/112 |
| 4,395,238 | 7/1983 | Payne | 440/53 |
| 4,623,313 | 11/1986 | Ferguson | 440/77 |
| 4,753,619 | 6/1988 | Sullivan | 440/88 |
| 4,927,392 | 5/1990 | Makihara et al. | 440/88 |

FOREIGN PATENT DOCUMENTS

| | | | |
|---|---|---|---|
| 1026729 | 4/1953 | France . | |
| 2161772 | 1/1986 | United Kingdom | 440/88 |

*Primary Examiner*—Sherman Basinger
*Attorney, Agent, or Firm*—Michael, Best & Friedrich

[57] ABSTRACT

Marine apparatus comprising a boat including a wall extending generally in the fore and aft direction and having therein an air outlet opening, a propulsion unit mounted on the boat and including a propeller shaft, an engine drivingly connected to the propeller shaft, and a cover surrounding the engine and having therein an air inlet opening, and a duct communicating between the air outlet opening and the air inlet opening.

30 Claims, 3 Drawing Sheets

80
76
30
198
214
46
90
220
224
88
64
100
150
186
72
42
94
92
160
250
254
4
4
60
22
14
258
84
68
56
18

10
190
198
222
166
150
174
186
214
224
3
3
182
46
220
54
200
94
170
194
14

ARRANGEMENT FOR SUPPLYING COMBUSTION AIR TO AN OUTBOARD MOTOR

This is a continuation of co-pending application Ser. No. 644,001, filed Jan. 18, 1991 and now abandoned.

BACKGROUND OF THE INVENTION

The invention relates to marine propulsion devices, and more particularly to arrangements for supplying combustion air to outboard motors.

It is known to use flexible conduits extending between the transom of a boat and the cover or shroud of an outboard motor for supplying combustion air to the engine of the outboard motor. Examples of known arrangements are disclosed in the following U.S. Patents:

| | | |
|---|---|---|
| Blanchard | 4,371,348 | Feb. 1, 1983 |
| Stevens | 4,375,356 | Mar. 1, 1983 |
| Payne | 4,395,238 | Jul. 26, 1983 |
| Makihara, et al. | 4,927,392 | May 22, 1990 |

Attention is also directed to the duct arrangement disclosed in U.S. Pat. No. 4,753,619.

Attention is also directed to U.S. Pat. No. 5,078,629 titled "Pivotal Air Induction for Marine Propulsion Unit".

SUMMARY OF THE INVENTION

The invention provides a marine apparatus comprising a boat including a wall extending generally in the fore and aft direction and having therein an air outlet opening, a propulsion unit mounted on the boat and including a propeller shaft, an engine drivingly connected to the propeller shaft, and a cover surrounding the engine and having therein an air inlet opening, and duct means communicating between the air outlet opening and the air inlet opening.

The invention also provides a marine apparatus comprising a boat including a wall having therein an air outlet opening, a propulsion unit mounted on the boat and including a propeller shaft, an engine drivingly connected to the propeller shaft, and a cover surrounding the engine and having therein an air inlet opening, and duct means which communicates between the air outlet opening and the air inlet opening and which is connected to one of the wall and the cover solely by interengagement of the duct means and the one of the wall and the cover.

The invention also provides a marine apparatus comprising a boat including opposed first and second walls extending generally in the fore and aft direction, one of the first and second walls having therein an air outlet opening, a propulsion unit including a propeller shaft, an engine drivingly connected to the propeller shaft, and a cover surrounding the engine and including a side wall which is generally parallel to the boat wall and which has therein an air inlet opening, means for supporting the propulsion unit between the first and second walls for pivotal movement relative to the boat about a generally horizontal tilt axis, and a flexible, resilient duct which communicates between the air outlet opening and the air inlet opening for conducting combustion air to the engine and which is connected to the cover solely by non-threaded interengagement of the duct and the cover.

A principal feature of the invention is the provision of a conduit extending between the side of an outboard motor cover and a boat wall which extends generally in the fore and aft direction and which is located to the side of the outboard motor rather than in front of the outboard motor.

Another principal feature of the invention is the provision of an accordion-like conduit connected to an outboard motor cover solely by non-threaded interengagement of the conduit and the cover. In other words, the conduit is not threadedly connected to the cover, and no additional securing means, such as an adhesive, the spring clamp disclosed in U.S. Pat. No. 4,753,619 or the clamping arrangement disclosed in U.S. Pat. No. 4,375,356, is used to connect the conduit to the cover. Preferably, the portion of the cover surrounding the air inlet opening in the cover is captured between a pair of endless ribs on the conduit.

Other features and advantages of the invention will become apparent to those skilled in the art upon review of the following detailed description, claims and drawings.

Figure 2:
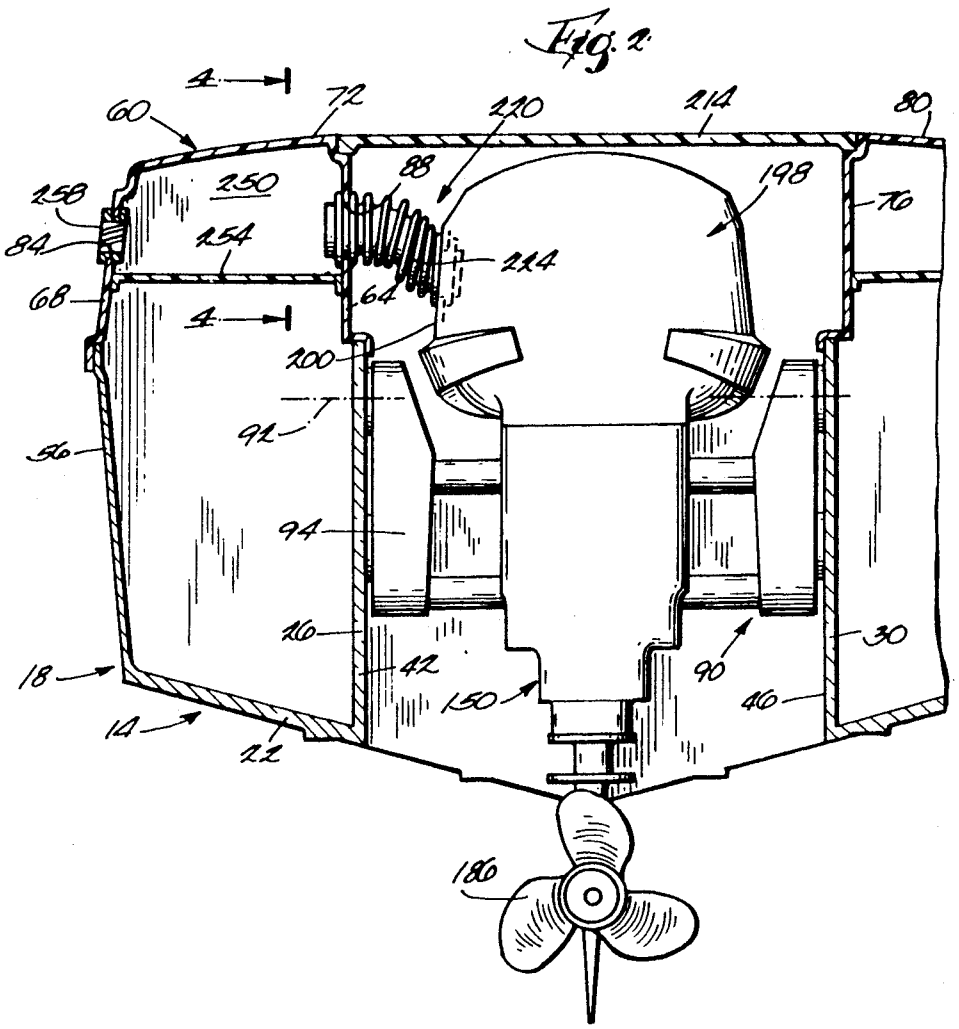
FIG. 2 is a right end view, partially in section, of the apparatus shown in FIG. 1.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine apparatus 10 embodying the invention is illustrated in the drawings. Except as described hereinafter, the marine apparatus 10 is substantially identical to the apparatus disclosed in U.S. Ser. No. 637,620, which was filed Jan. 4, 1991, now abandoned and which is incorporated herein by reference.

The apparatus 10 comprises a recreational boat 14, preferably a fiberglass boat, including a hull 18. The hull 18 includes (see FIG. 2) a fiberglass bottom 22 supported in part by generally parallel, spaced-apart first and second or port and starboard supporting members or stringers 26 and 30, respectively, extending in the fore and aft direction. The stringers 26 and 30 are preferably made of plywood and are covered with fiberglass on all sides in order to resist deterioration and provide additional strength. Each stringer 26 or 30 includes a rearward portion coated on its inner surface with additional fiberglass so as to form a pair of opposed, facing first and second or port and starboard inner walls 42 and 46, respectively, extending generally vertically and in the fore and aft direction. The additional fiberglass has a pigment so as to hide the plywood of the stringers 26 and 30. The walls 42 and 46 define therebetween a space adapted to contain an outboard motor.

The boat hull 18 also includes (see FIG. 1) a lateral rear wall or "transom" 54 extending generally vertically and between the opposed walls 42 and 46. The wall 54 has a height substantially equal to the height of the walls 42 and 46.

The hull 18 also includes (see FIG. 2) port and starboard outer walls (only the port outer wall 56 is shown in the drawings) located outwardly of the inner walls 42 and 46, respectively. Each of the outer walls has an upper end.

The hull 18 also includes (see FIG. 2) a fiberglass deck 60 supported on the upper ends of the stringers 26 and 30 and on the upper ends of the outer walls of the hull 18. The deck 60 includes a first or port inner wall 64 extending vertically and upwardly from the port wall 42 and generally in the fore and aft direction, a port outer wall 68 extending upwardly from the outer wall 56, a port upper wall 72 extending between the deck walls 64 and 68, a second or starboard inner wall 76 extending vertically and upwardly from the starboard wall 46 and generally in the fore and aft direction, a starboard outer wall (not shown) extending upwardly from the starboard hull outer wall, and a starboard upper wall 80. The walls 64 and 76 can be considered to be part of or extensions of the walls 42 and 46, respectively. The upper surfaces of the walls 72 and 80 preferably serve as swimming platforms. The wall 68 is partially defined by a surface having therein an air intake opening 84, and the wall 64 has therein an air outlet opening 88. The reason for the openings 84 and 88 is explained hereinafter.

The marine apparatus 10 also comprises means 90 connected to the walls 42 and 46 for supporting a propulsion unit for pivotal movement relative to the boat 14 about a generally horizontal tilt axis 92 (FIG. 2) which, in the illustrated embodiment, intersects the walls 42 and 46. The means 90 preferably includes (see FIGS. 1 and 2) a mounting bracket 94 connected to the walls 42 and 46 for pivotal movement relative thereto about the tilt axis 92.

The marine apparatus 10 also comprises (see FIGS. 1 and 2) an outboard motor 150 mounted on the mounting bracket 94 and located between the walls 42 and 46 or between the walls 64 and 76. While the outboard motor 150 can have various suitable constructions, in the illustrated construction, the outboard motor 150 includes (see FIG. 1) a propulsion unit 166 mounted on the mounting bracket 94 for pivotal movement relative thereto about a generally vertical steering axis 170. The propulsion unit 166 includes a drive shaft housing 174, a propeller shaft 182 rotatably supported by the drive shaft housing 174, and a propeller 186 mounted on the propeller shaft 182. The propulsion unit 166 also includes an engine 190 supported by the drive shaft housing 174 and drivingly connected to the propeller shaft 182 by a conventional drive train 194. The propulsion unit 166 also includes a cowling or cover or shroud 198 which is mounted on the upper end of the drive shaft housing 174 and which surrounds the engine 190. The cover 198 includes a side wall or portion 200 partially defined by a surface which extends generally vertically and in the fore and aft direction, which is generally parallel to the deck wall 64 (the cover wall 200 is not exactly planar but is somewhat curved), and which has therein (see FIG. 3) an air inlet opening 204 for admitting combustion air for the engine 190. The cover 198 includes an endless portion 208 surrounding the opening 204.

Figure 1:
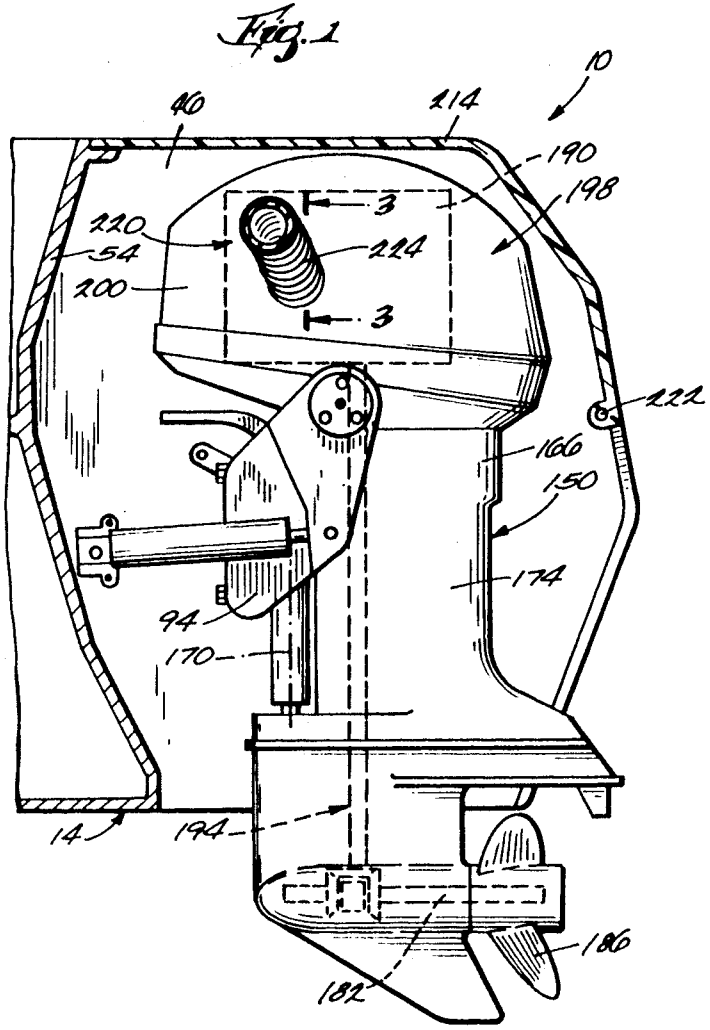
FIG. 1 is a partial side elevational view, partially in section, of a marine apparatus embodying the invention.

The marine apparatus 10 further comprises (see FIGS. 1 and 2) a cover 214 extending above the outboard motor 150. The cover 214 is mounted on the hull 18 for pivotal movement relative thereto about a generally horizontal axis 222 (FIG. 1). In the illustrated construction, the cover 214 is pivotally connected to the walls 42 and 46 at a point near the rearward end of the boat 14.

The marine apparatus 10 further comprises (see FIG. 2) duct means 220 extending between the facing surfaces defining the wall 68 and the side wall 200 and communicating between the air outlet opening 88 and the air inlet opening 204. While various suitable duct means can be employed, in the construction illustrated in FIGS. 1–4, the duct means 220 includes an accordion-like, flexible conduit 224 including (see FIG. 3) a plurality of longitudinally spaced, endless ribs 228 defining a plurality of longitudinally spaced, endless crests 232 in alternating relationship with a plurality of longitudinally spaced, endless valleys 236. The conduit 224 is preferably made of a resilient material such as rubber or neoprene.

Figure 3:
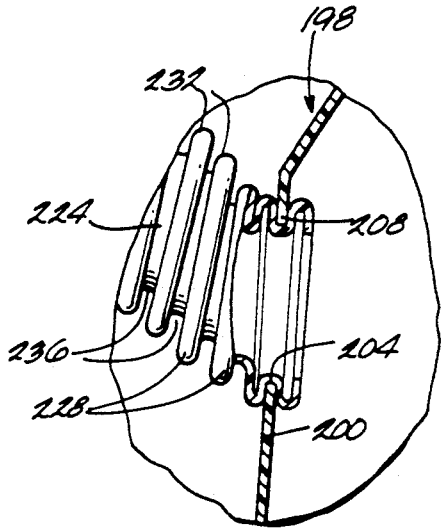
FIG. 3 is an enlarged view taken along line 3–3 in FIG. 1.

In the construction illustrated in FIGS. 1–4, the conduit 224 is connected to the outboard motor cover 198 solely by non-threaded interengagement of the conduit 224 and the cover 198, and the conduit 224 is connected to the boat wall 64 solely by non-threaded interengagement of the conduit 224 and the wall 64. "Solely by non-threaded interengagement" means connection without adhesives, threads or any additional connecting means such as a spring clamp. As shown in FIG. 3, the portion 208 of the outboard motor cover 198 surrounding the air inlet opening 204 is captured between a pair of the conduit ribs 228. In other words, the portion 208 of the outboard motor cover 198 surrounding the air inlet opening 204 is located in one of the conduit valleys 236. The conduit 224 is similarly connected to the boat wall 64, i.e., the portion of the boat wall 64 surrounding the air outlet opening 88 is captured between a pair of the conduit ribs 228 or is located in one of the conduit valleys 236.

The conduit 224 is connected to the outboard motor cover 198 by collapsing the end of the conduit 224, inserting the collapsed end of the conduit 224 into the air inlet opening 204 so that the conduit 224 is in the desired location, and allowing the end of the conduit 224 to expand so that the portion 208 of the cover 198 surrounding the air inlet opening 204 is captured between a pair of ribs 228 as described above. The conduit 224 is similarly connected to the boat wall 64.

Figure 4:
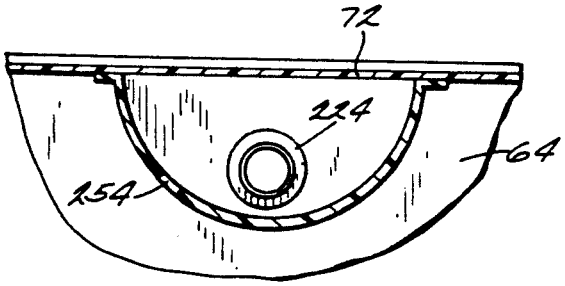
FIG. 4 is a view taken along line 4–4 in FIG. 2.

The marine apparatus 10 also comprises means communicating between the air intake opening 84 and the air outlet opening 88 for conducting air therebetween. While various suitable conducting means can be used, in the illustrated construction, the boat 14 defines (see FIG. 2) a chamber 250 communicating between the openings 84 and 88. More particularly, as shown in FIGS. 2 and 4, the boat 14 includes an elongated, U-shaped member 254 extending between the walls 64 and 68 and cooperating with the walls 64, 68 and 72 to define the chamber 250. Furthermore, in the illustrated construction, the air intake opening 84 has therein (see FIG. 2) a grill 258 that allows air to pass through the opening 84 and that substantially prevents objects from entering the opening 84.

Thus, combustion air for the engine 190 flows through the air intake opening 84, through the chamber 250 and through the conduit 224 to the interior of the cover 198 and thereby to the engine 190. The flexible conduit 224 allows pivotal movement of the outboard motor 150 throughout its trim and tilt range.

Figure 5:
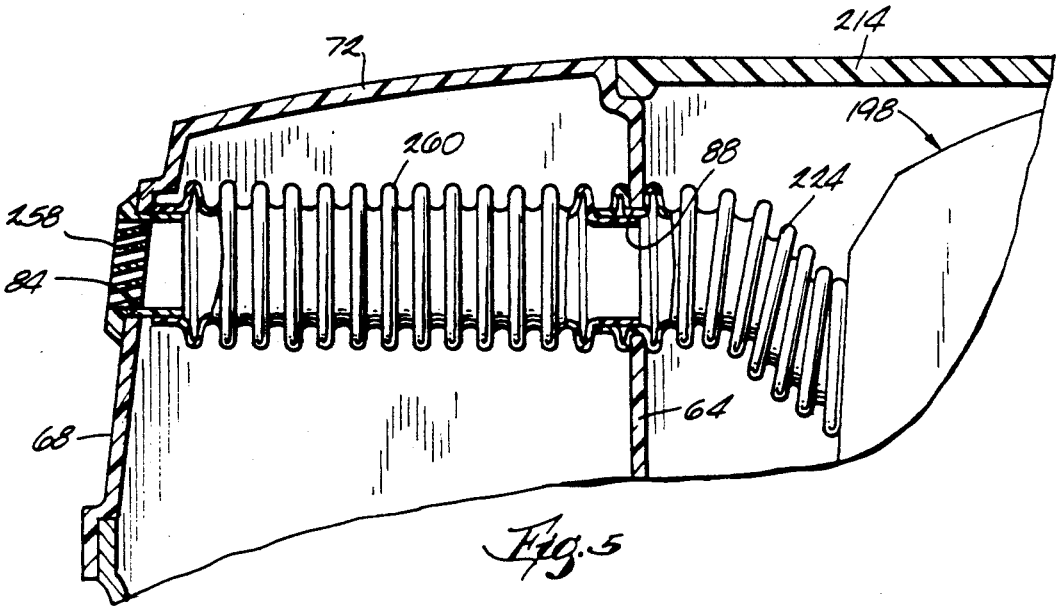
FIG. 5 is an enlarged sectional view of an alternative embodiment of the invention.

An alternative embodiment of the invention is illustrated in FIG. 5. Except as described below, the alternative embodiment is substantially identical to the embodiment illustrated in FIGS. 1–4, and common elements have been given the same reference numerals.

In the alternative embodiment illustrated in FIG. 5, the means communicating between the air intake opening 84 and the air outlet opening 88 includes a flexible conduit 260 communicating between the openings 84 and 88. As shown in FIG. 5, the conduit 260 is substantially identical to the conduit 224 except for its length. The conduit 260 includes an outer end communicating with the grill 258 and an inner end communicating with the conduit 224. More particularly, the inner end of the conduit 260 extends inside the outer end of the conduit 224 in telescoping relation thereto, and the outer end of the conduit 260 surrounds a cylindrical portion of the grill 258 in telescoping relation thereto.

Figure 6:
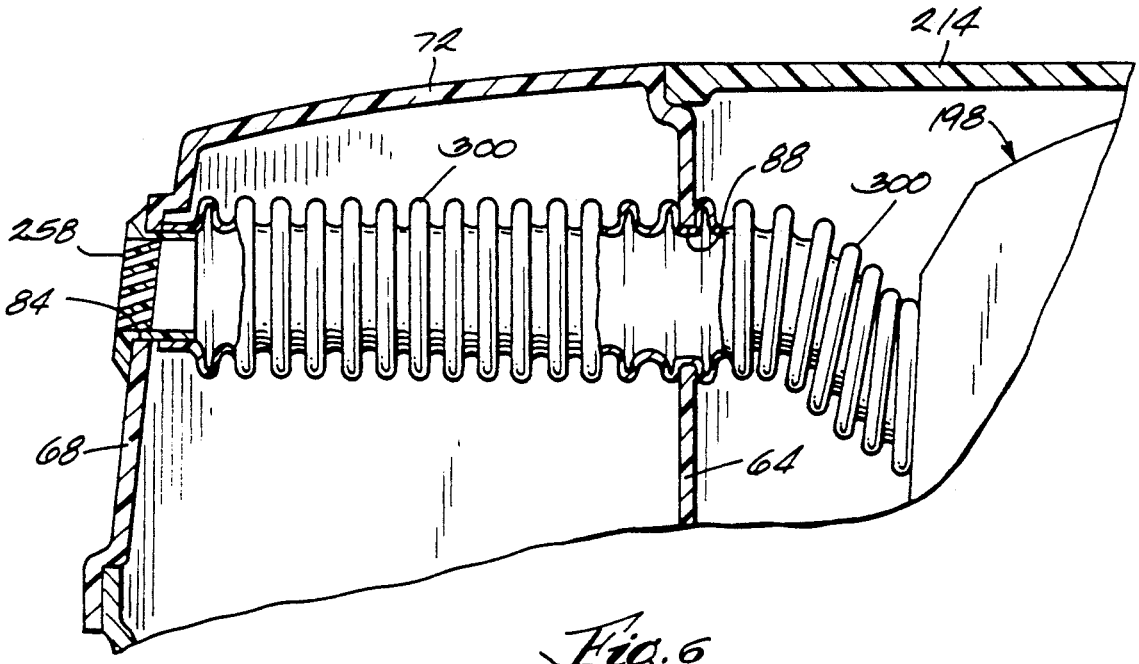
FIG. 6 is an enlarged sectional view similar to FIG. 5 of a second alternative embodiment of the invention.

A second alternative embodiment of the invention is illustrated in FIG. 6. Except as described below, the second alternative embodiment is substantially identical to the embodiment illustrated in FIG. 5, and common elements have been given the same reference numerals.

In the alternative embodiment illustrated in FIG. 6, the conduits 224 and 260 shown in FIG. 5 are replaced by a single conduit 300 extending from the air intake opening 84, through the air outlet opening 88 and to the air inlet opening 204. The conduit 300 is substantially identical to the conduit 224 except for its length. The conduit 300 is connected to the grill 258 in the same manner as the conduit 260 is in FIG. 5, and the conduit 300 is connected to the cover 198 in the same manner as the conduit 224 is in FIG. 3. The portion of the wall 64 surrounding the opening 88 is captured between two of the ribs of the conduit 300

Various features of the invention are set forth in the following claims.

We claim:

1. Marine apparatus comprising a boat including a hull, said hull including a wall having an aft end and extending generally in the fore and aft direction and said wall having therein an air outlet opening, a propulsion unit mounted on said boat and including a propeller shaft, an engine drivingly connected to said propeller shaft, and a cover having an aft end located forwardly of said aft end of said wall, surrounding said engine, and having therein an air inlet opening, a duct means communicating between said air outlet opening and said air inlet opening.

2. An apparatus as set forth in claim 1 wherein said duct means is flexible.

3. An apparatus as set forth in claim 1 wherein said cover includes a side wall which is generally parallel to said boat wall and which has therein said air inlet opening.

4. An apparatus as set forth in claim 1 wherein said boat includes opposed first and second walls extending generally in the fore and aft direction, wherein said air outlet opening is located in one of said first and second walls, and wherein said propulsion unit is located between said first and second walls.

5. An apparatus as set forth in claim 1 wherein said boat includes an outer wall which is spaced from said first-mentioned wall and which has therein an air intake opening communicating with the atmosphere, and means communicating between said air intake opening and said air outlet opening for conducting air therebetween.

6. An apparatus as set forth in claim 5 wherein said conducting means includes a chamber defined by said boat.

7. An apparatus as set forth in claim 5 wherein said conducting means includes a conduit communicating between said air intake opening and said air outlet opening.

8. An apparatus as set forth in claim 1 wherein said duct means is connected to said cover solely by interengagement of said duct means and said cover.

9. An apparatus as set forth in claim 8 wherein said duct means is accordion-like and includes a plurality of longitudinally spaced, endless ribs, and wherein said cover includes an endless portion which surrounds said air inlet opening and which is captured between a pair of said ribs.

10. An apparatus as set forth in claim 9 wherein said ribs define a plurality of longitudinally spaced, endless crests in alternating relationship with a plurality of longitudinally spaced, endless valleys, and wherein said portion of said cover is located in one of said valleys.

11. Marine apparatus comprising a boat including a first wall extending generally in the fore and aft direction and having therein an air outlet opening, a second wall which extends in fixed relation to, in generally parallel relation to, and in spaced relation from said first wall and which has therein an air intake opening communicating with the atmosphere, conduit means communicating between said air intake opening and said air outlet opening for conducting air therebetween, a propulsion unit mounted on said boat and including a propeller shaft, an engine drivingly connected to said propeller shaft, a cover spaced from said first wall int he direction opposite from the spacing of said second wall, surrounding said engine, and having therein an air inlet opening, and flexible duct means which communicates between said air outlet opening and said air inlet opening.

12. An apparatus as set forth in claim 11 wherein said duct means is made of a resilient material.

13. An apparatus as set forth in claim 11 wherein said duct means is flexible.

14. An apparatus as set forth in claim 11 wherein said cover includes a side wall which is generally parallel to said first boat wall and which has therein said air inlet opening.

15. An apparatus as set forth in claim 11 wherein said boat includes a third wall extending generally in the fore and aft direction, and wherein said propulsion unit is located between said first and third walls.

16. An apparatus as set forth in claim 11 wherein said conducting means includes a chamber defined by said boat.

17. An apparatus as set forth in claim 11 wherein said conducting means includes a flexible conduit communicating between said air intake opening and said air outlet opening.

18. Marine apparatus as set forth in claim 11 wherein said duct means is connected to one of said first wall and said cover solely by interengagement of said duct means and said one of said first wall and said cover.

19. An apparatus as set forth in claim 18 wherein said interengagement is non-threaded.

20. An apparatus as set forth in claim 18 wherein said duct means is connected to said cover solely by interengagement of said duct means and said cover.

21. An apparatus as set forth in claim 20 wherein said duct means is accordion-like and includes a plurality of longitudinally spaced, endless ribs, and wherein said cover includes an endless portion which surrounds said air inlet opening and which is captured between a pair of said ribs.

22. An apparatus as set forth in claim 21 wherein said ribs define a plurality of longitudinally spaced, endless crests in alternating relationship with a plurality of longitudinally spaced, endless valleys, and wherein said portion of said cover is located in one of said valleys.

23. Marine apparatus comprising a boat including a hull with a wall extending generally in the fore and aft direction and below the water during normal operation of said boat, said wall having therein an air outlet opening, a propulsion unit mounted on said boat and including a propeller shaft, an engine drivingly connected to said propeller shaft, and a cover surrounding said engine and having therein an air inlet opening, and duct means communicating between said air outlet opening and said air inlet opening.

24. Marine apparatus comprising a boat including a hull, a stringer, a deck supported by said stringer, and a wall extending generally in the fore and aft direction and including a lower portion formed at least in part by said stringer and an upper portion formed at least in part by said deck, said wall having therein an air outlet opening, a propulsion unit mounted on said boat and including a propeller shaft, an engine drivingly connected to said propeller shaft, and a cover surrounding said engine and having therein an air inlet opening, and duct means communicating between said air outlet opening and said air inlet opening.

25. Marine apparatus comprising a boat including a wall which extends generally in the fore and aft direction, which has an aft end and a fore end, and which has therein an air outlet opening, a propulsion unit mounted on said boat and including a propeller shaft, an engine drivingly connected to said propeller shaft, and a cover which surrounds said engine, which has an aft end located forwardly of said aft end of said wall, which has a fore end located rearwardly of said fore end of said wall, and which has therein an air inlet opening, and duct means communicating between said air outlet opening and said air inlet opening.

26. Marine apparatus as set forth in claim 25 wherein said boat includes a stringer and a deck supported by said stringer, and wherein said wall includes a lower portion formed at least in part by said stringer and an upper portion formed at least in part by said deck.

27. Marine apparatus comprising a boat including a first wall having therein an air outlet opening, a second wall fixed with respect to said first wall and having therein an air intake opening, a conduit communicating between said air intake opening and said air outlet opening for conducting air therebetween, a propulsion unit mounted on said boat, and including a propeller shaft, an engine drivingly connected to said propeller shaft, and a cover surrounding said engine and having therein an air inlet opening, and flexible duct means communicating between said air outlet opening and said air inlet opening.

28. Marine apparatus comprising a boat including a hull, said hull including a first wall which extends generally in the fore and aft direction, which has an aft end and a fore end, which extends below water during normal operation of said boat, and which has therein an air outlet opening, and a second wall which is generally parallel to and spaced from said first wall and which has therein an air intake opening, means communicating between said air intake opening and said air outlet opening for conducting air therebetween, a propulsion unit mounted on said boat and including a propeller shaft, an engine drivingly connected to said propeller shaft, and a cover which surrounds said engine, which has an aft end located forwardly of said aft end of said first wall, which has a fore end located rearwardly of said fore end of said first wall, and which has therein an air inlet opening, and a flexible conduit communicating between said air outlet opening and said air inlet opening.

29. Marine apparatus as set forth in claim 28 wherein said hull includes a stringer and a deck supported by said stringer, and wherein said first wall includes a lower portion formed at least in part by said stringer and an upper portion formed at least in part by said deck.

30. A boat comprising a first wall extending generally in the fore and aft direction, and below the water during normal boat operation, and having therein an air outlet opening adapted to communicate with a propulsion unit, a second wall which is generally parallel to and spaced from said first wall and which has therein an air intake opening, a third wall which is generally parallel to and spaced from said first wall in the direction opposite from the spacing of the second wall and so as to define between said first and third walls a space adapted to contain the propulsion unit, and means communicating between said air intake opening and said air outlet opening for conducting air therebetween.

* * * * *